US005934634A

United States Patent [19]

Lindblom

[11] Patent Number: 5,934,634

[45] Date of Patent: Aug. 10, 1999

[54] CARRIER AND RELEASABLE HOLDER FOR SUPPORTING GOODS ANYWHERE ALONG A VERTICAL POST

[75] Inventor: Rolf Lindblom, Vällingby, Sweden

[73] Assignee: Satellit-System AB, Vallingby, Sweden

[21] Appl. No.: 08/849,095

[22] PCT Filed: Nov. 23, 1995

[86] PCT No.: PCT/SE95/01399

§ 371 Date: Jun. 16, 1997

§ 102(e) Date: Jun. 16, 1997

[87] PCT Pub. No.: WO96/16578

PCT Pub. Date: Jun. 6, 1996

[30] Foreign Application Priority Data

Nov. 28, 1994 [SE] Sweden ..... 9404114

[51] Int. Cl.[6] ..... A47B 35/00; A47B 96/06

[52] U.S. Cl. ..... 248/230.1; 248/219.3; 248/125.1; 248/295.11; 108/50.12; 211/107; 211/133.4; 206/557

[58] Field of Search ..... 248/230.1, 230.2, 248/218.4, 219.3, 219.4, 220.22, 220.21, 125.1, 295.11; 108/50.12, 94, 95, 144.11, 146, 147.11, 147.12, 147.13, 147.15, 147.17; 211/107, 110, 144, 133.4; 206/557, 564; 403/334, 333, 109, 377, 370; 47/25

[56] References Cited

U.S. PATENT DOCUMENTS

| | | | |
|---|---|---|---|
| 1,155,638 | 10/1915 | Bowen . | |
| 2,951,593 | 9/1960 | Lake | 108/94 X |
| 3,167,292 | 1/1965 | Meyerowitz | 248/230.1 |
| 3,194,403 | 7/1965 | Van Horn, Jr. | 211/107 X |
| 3,223,467 | 12/1965 | Jafelice | 248/230.1 X |
| 3,414,133 | 12/1968 | Guerri et al. | 211/107 |
| 3,626,871 | 12/1971 | McClendon | 108/94 X |
| 3,757,705 | 9/1973 | Maslow | 108/147.13 |
| 4,128,064 | 12/1978 | Chung et al. | 108/147.13 X |
| 4,193,351 | 3/1980 | Belokin, Jr. . | |
| 5,127,342 | 7/1992 | Taylor | 108/147.13 |
| 5,277,488 | 1/1994 | Cleary et al. | 211/144 X |
| 5,715,954 | 2/1998 | Zaremba | 211/107 |

FOREIGN PATENT DOCUMENTS 502805 3/1971 Sweden .

*Primary Examiner*—Ramon O. Ramirez
*Assistant Examiner*—Stephen S. Wentsler
*Attorney, Agent, or Firm*—Young & Thompson

[57] ABSTRACT

A goods carrier (1) which can be fitted to a generally vertical post (2) which supports, for instance, a sunshade or umbrella. The carrier (1) includes a generally radial, open slot (7) whose width corresponds to the diameter of the post, wherein the bottom region (8) of the slot (7) through which the post (2) extends when the carrier (1) is fitted to the post widens axially so as to be broader at the bottom than at the top, when seen in the axial direction of the post (2). Fitted to the post (2) is a holder body (9) whose outer surface is configured to receive the bottom region (8) and to support the carrier (1) on the post (2).

4 Claims, 3 Drawing Sheets

CARRIER AND RELEASABLE HOLDER FOR SUPPORTING GOODS ANYWHERE ALONG A VERTICAL POST

The present invention relates to a goods carrier which can be fitted to a vertical post, such as an umbrella post.

It is known to produce a goods carrier in the form of a traylike device which is provided with a slot that is so configured as to enable a post to be inserted through the slot opening and, by embracing the post, secure the tray thereto.

Swiss Patent Specification CH 502,805 describes a display stand which includes a post on which a tray or bowl is attached and decorated and/or filled with goods. The object is to provide a bowl which can be detachably fitted to the post, so as to avoid filling an empty bowl with fresh goods with the tray attached to the post, which may have a disturbing effect. It should therefore be possible to replace an empty bowl with a bowl that has been pre-filled with goods, with a simple hand movement. This is made possible by the fact that the bowl is provided with a slot which extends from the post receiving opening to the periphery of the bowl and which enables the bowl to be fitted to and dismantled from the post. It is proposed that the bowl is configured so that it will firmly grip around the post and therewith be fixed securely thereto. According to one preferred embodiment, one side wall of the slot is resilient, for instance in the form of a lip which springs in front of the slot opening, wherein the bowl is clamped firmly to the post at the inner end of the slot and is detached from the post by pressing the lip away from the slot.

This solution, however, is not suitable for use in open-air cafes, restaurants or tea gardens, where the waiter or waitress carrying a tray in one hand only has one hand available to detach the bowl or tray from the post, i.e. is not able to press back the lip in order to detach the tray. Furthermore, it has been found difficult to provide by means of the clamping force generated by the aforesaid lip an anchorage of the strength required to support heavy loads, for instance a tray carrying a number of beer glasses. The tray taught by the aforesaid Swiss patent specification cannot be rotated around the post.

Accordingly, one object of the present invention is to provide a goods carrier which can be attached to a generally vertical post and which can be attached to and detached from the post with the aid of only one hand. Furthermore, when attached to the post, the carrier shall be able to support relatively heavy loads. A further object of the invention is to provide a carrier which can be moved around the post. These objects of the present invention cannot be achieved with the earlier known devices intended for the aforesaid purpose, but are achieved of the present invention with a goods carrier.

The invention will now be described in more detail with reference to a non-limiting embodiment thereof and also with reference to the accompanying drawings, in which FIG. 1 is a perspective view of the invention used together with a sunshade or rain umbrella;

Figure 1:
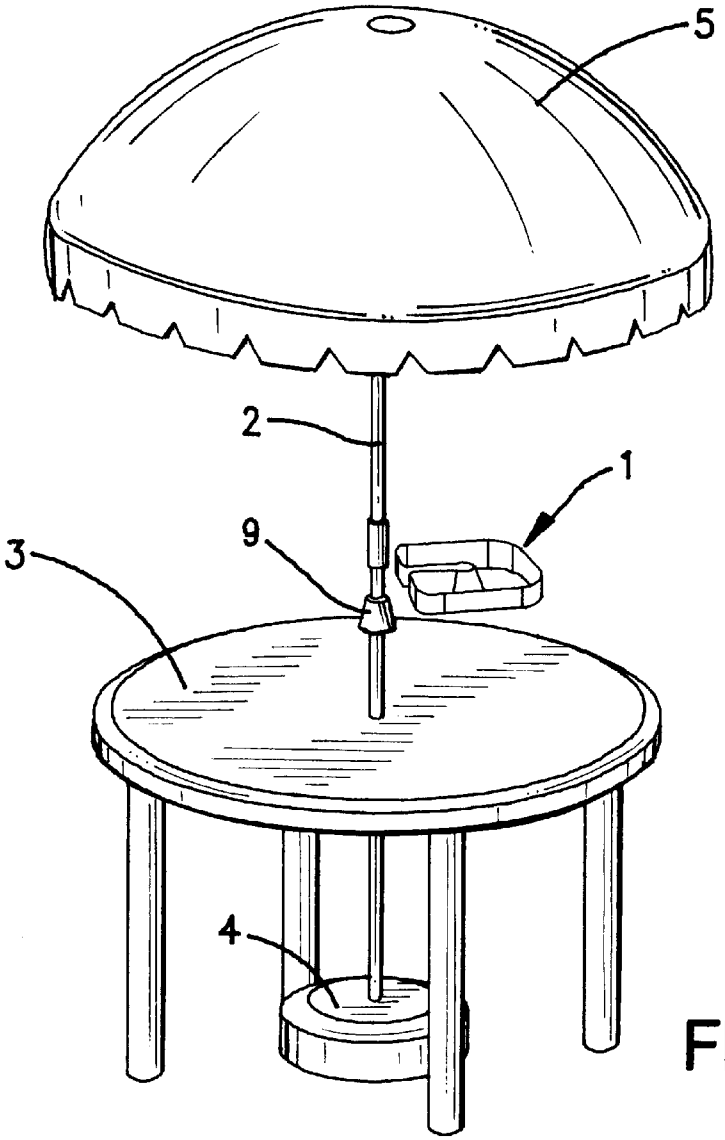

FIG. 1 illustrates an example of the manner in which the inventive goods carrier, referenced 1, is attached to a generally vertical post 2 which extends through a serving table 3, the bottom end of the post being anchored in a foot 4 and the upper end of the post supporting a sunshade or umbrella 5.

Figure 2:
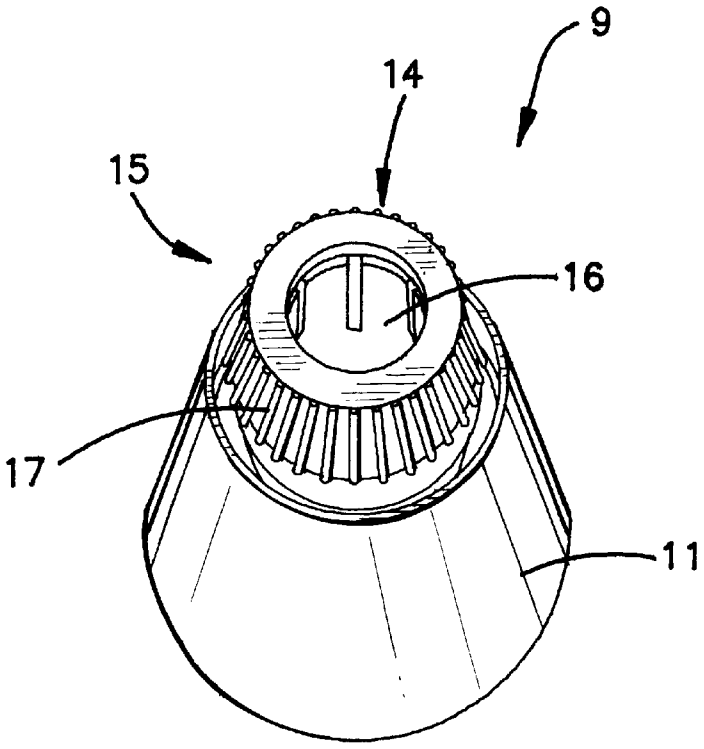
FIG. 2 illustrates a holder body forming part of the invention.
Figure 4:
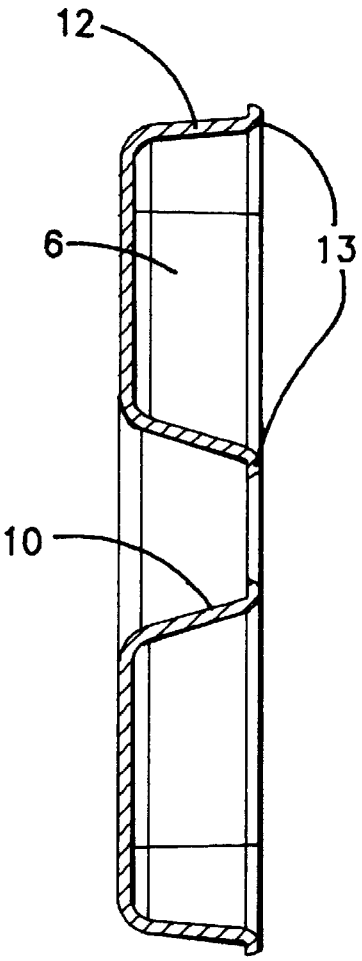
FIG. 4 is a sectional view of the tray shown in FIG. 3, taken on the line 1V–1V in FIG. 3.
Figure 3:
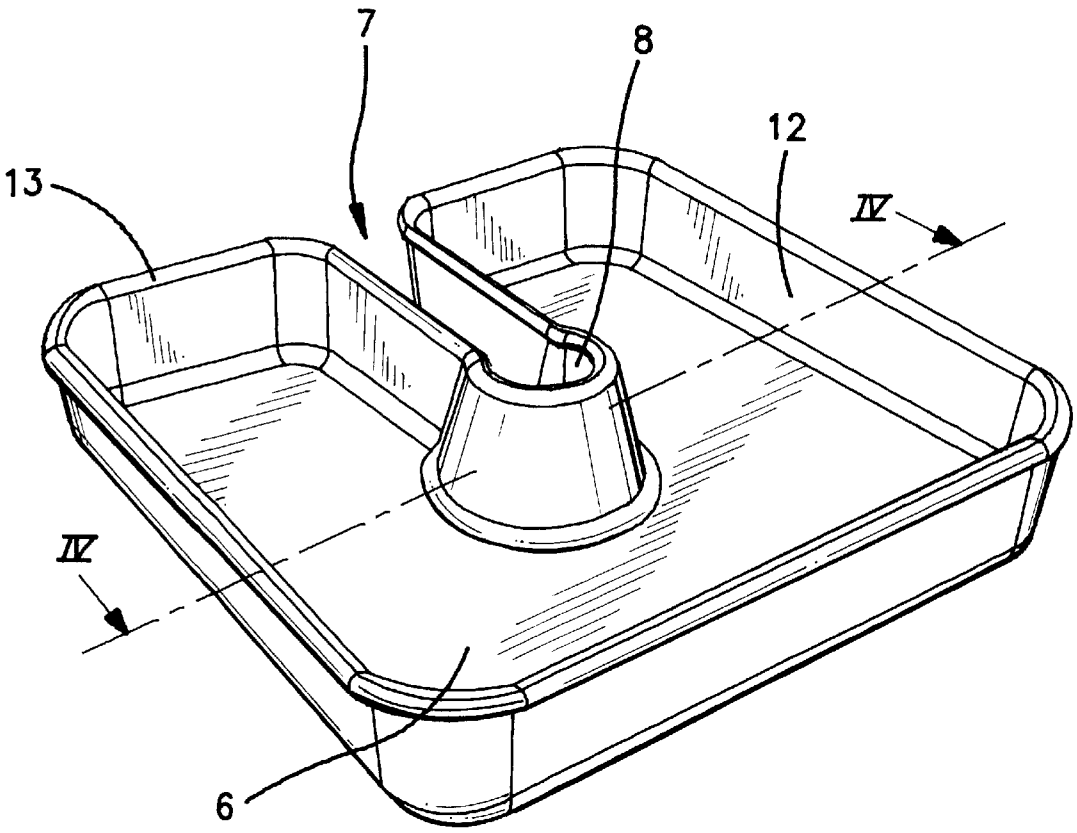
FIG. 3 is a perspective view from above of an inventive goods carrier, in the fore of a tray.

In the illustrated embodiment, the goods carrier 1 has the form of a tray 6 on which the goods, or items, shall be placed. The tray includes a generally radial, open slot 7 whose width corresponds to the diameter of the post 2. The slot 7 has a radially inward bottom region 8 through which the post a extends when the tray 6 is fitted thereto and which is extended axially, as will best be seen from FIG. 4, so that the bottom region 8 is wider at the bottom than at the top, as seen in the axial direction of the post 2. Shown in FIG. 2 is a holder body 9 which can be fitted to the post so as to support the tray 6 thereon and the outside of which is configured to receive and accommodate the bottom region 8 of the slot 7.

For the purpose of attaching and supporting the tray 6 on the holder body 9, the bottom region 8 of the slot 7 has an internal contact region 10 which corresponds to the shape of a corresponding contact region 11 on the outside of the holder body 9. In the case of the illustrated embodiment, respective contact regions 10, 11 have a truncated conical shape with a diameter which decreases in an upward direction and the height of which is chosen to obtain the requisite surface abutment and therewith prevent the tray 6 from tipping.

In the case of the illustrated embodiment, the bottom region 8 of the slot 7 with said contact regions 10, 11 is formed by a stiffening side piece 12 which extends around the outer edge of the tray 6 and which is formed integrally with the tray.

Extending continuously around the upper free edge of the side piece 12 is an outwardly projecting flange 13 which functions to stiffen the tray 6 and which is able to support against the peripheral surface of the rod 2 or against the upper end part of the holder body 9 for instance, at a location above said holder body and therewith support the tray 6 when the tray is unevenly loaded.

The holder body 9 includes a preferably centrally located, through-penetrating hole 14 which enables the holder body 9 to be moved along the post 2, and also includes a latching device 15 which enables the holder body to be secured in selected positions on the post 2. As shown in FIG. 2, the latching device 15 is located on one of the end sides of the holder body 9, for instance the upper side, so as to enable the latching device to be reached when the holder body 9 supports the tray 6, and is preferably comprised of a known cone 16 which can be clamped firmly to the post 2 with the aid of an adjustable nut 17 provided on the holder body.

The tray 6 is attached to the post 2, by passing the post 2 through the slot 7 until the post 2 reaches the bottom region 8 of the slot, whereafter the tray 6 is lowered so that the bottom region 8 will rest on the holder body 9 fixed to the post 2. Because the inner surface of the bottom region 8 on the tray 6 has a shape which corresponds to the shape of the outer surface of the holder body 9, the two surfaces will be in shape-locking engagement with one another.

Figure 5:
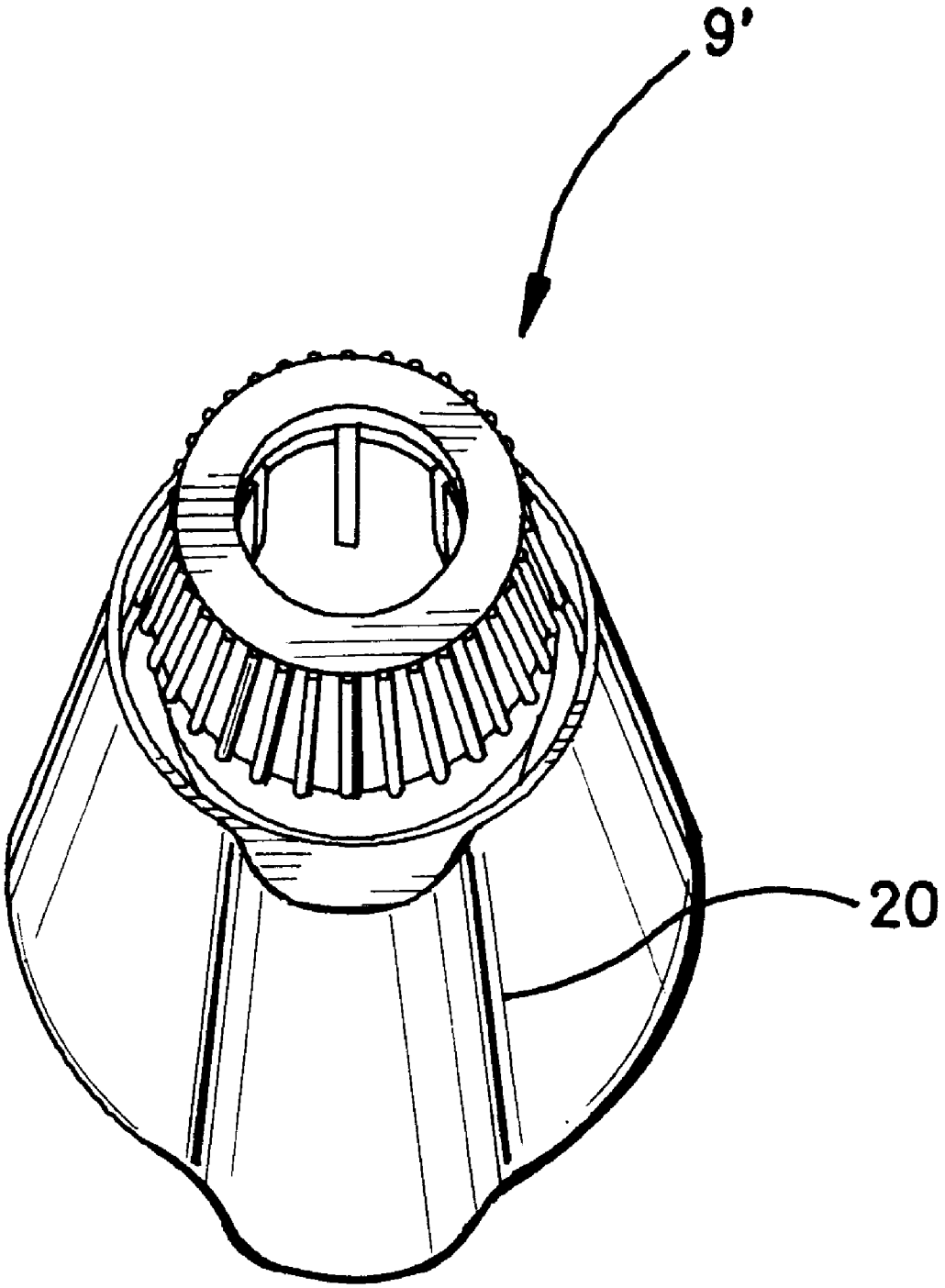
FIG. 5 illustrates an alternative embodiment of the holder body of the present invention.

In order to enable the tray 6 carried on the holder body 9 to be rotated around the post 2, the mutually abutting contact surfaces 10, 11 of said respective parts will preferably be rotationally symmetrical, e.g. have the illustrated truncated conical shape or a circular-cylindrical shape. Alternatively, and with refernce to FIG. 5, the mutually abutting contact surfaces 10, 11 of respective parts may be correspondingly asymmetrical in shape, having one or more symmetrically disposed corners 20 to non-rotatably fix the tray 6 to the holder body 2.

The tray 6 is detached from the post 2 in the reverse order to that described above, by first lifting the tray 6 upwardly from the holder part 9 and then withdrawing the tray along the entry slot 7 (c.f. also FIG. 1 in this regard).

The aforedescribed components of the inventive carrier are advantageously made of some extrudible plastic material, which has the advantage that an extruded part can be manufactured to close tolerances and with good profitability. By way of example, a goods carrier can be Made of a wire material and configured to carry drink glasses, or constructed to provide a rack on which articles can be hung, etc. A common feature of all goods carriers constructed in accordance with the invention is that they include a slot having a bottom region configured in accordance with the invention, and that there is provided a holder body whose outer surface is configured to receive the bottom region, therewith to support the goods carrier.

It will be understood that the invention is not restricted to the aforedescribed and illustrated embodiments thereof and that modifications can be made within the scope of the inventive concept as defined in the following Claims.

I claim:

1. A device for supporting goods anywhere along a generally vertical post, the device comprising:

a removable carrier for carrying the goods to be supported anywhere along the post, said carrier having a central opening and a slot that opens from a periphery of said carrier to said central opening for removably passing the post through said slot into said central opening, said central opening having an inner surface with a frusto-conical shape with a top that is narrower than a bottom; and a holder body separate from said carrier and comprising a supporting portion with an outer surface with a frusto-conical shape with a top that is narrower than a bottom for fitting into said central opening and a hole for receiving the post so that said holder body removably supports said carrier when said inner surface is placed adjacent said outer surface, said outer surface being rotationally asymmetrical for preventing rotation of said carrier relative to said holder body, said holder body further comprising a latch attached to said supporting portion and an internal opening for receiving the post, said latch having a rotatable portion that is rotatable relative to said supporting portion in a first direction for reducing a diameter of said internal opening to compressibly secure said holder body to any position along the post and rotatable relative to said supporting portion in a second direction for increasing the diameter of said internal opening to release said holder body from securement to the post.

2. The device of claim 1, wherein said carrier further comprises a lip that projects into said central opening at the top thereof for supporting said carrier on the top of said supporting portion.

3. The device of claim 1, wherein said carrier is a tray with sides.

4. The device of claim 1, wherein said rotatable portion of said latch extends axially from said supporting portion so that said rotatable portion can be rotated when said carrier is mounted on said holding body to move said holding body and said carrier along the post together.

* * * * *